US007591370B1

(12) United States Patent
Schnaars

(10) Patent No.: US 7,591,370 B1
(45) **Date of Patent: *Sep. 22, 2009**

(54) POT BELLY BAG WITH A PAIR OF SLEEVES

(76) Inventor: Daniel R. Schnaars, 153 S. Long St., Lafayette, LA (US) 70506

( * ) Notice: Subject to any disclaimer, the term of this patent is extended or adjusted under 35 U.S.C. 154(b) by 523 days.

This patent is subject to a terminal disclaimer.

(21) Appl. No.: 11/253,800

(22) Filed: Oct. 18, 2005

Related U.S. Application Data

(60) Provisional application No. 60/619,853, filed on Oct. 18, 2004.

(51) Int. Cl.
*B65D 19/00* (2006.01)
*B65D 33/02* (2006.01)

(52) U.S. Cl. ..... 206/386; 206/599; 206/600; 383/119

(58) Field of Classification Search ..... 206/386, 206/595–600; 108/51.11, 55.1, 56.3; 383/119, 383/121–121.1, 24
See application file for complete search history.

(56) References Cited

U.S. PATENT DOCUMENTS

| | | | | |
|---|---|---|---|---|
| 2,698,696 | A | 1/1955 | Strong | |
| 4,364,424 | A | 12/1982 | Nattrass | |
| RE32,308 | E | 12/1986 | Nattrass | |
| 4,830,191 | A | 5/1989 | Dijksman | |
| 5,465,865 | A | 11/1995 | Coombes | |
| 5,507,237 | A | 4/1996 | Barrow et al. | |
| 5,613,447 | A | 3/1997 | Trickett | |
| 5,785,175 | A | 7/1998 | Cholsaipant | |
| 6,213,305 | B1 | 4/2001 | Baker et al. | |
| 6,390,675 | B1 | 5/2002 | Jardine | |
| 6,467,625 | B2 | 10/2002 | Baker et al. | |
| D492,835 | S * | 7/2004 | Michaels et al. | D34/38 |
| 6,926,144 | B1 | 8/2005 | Schnaars, Jr. et al. | |
| 6,935,500 | B1 | 8/2005 | Schnaars | |
| 7,207,443 | B2 | 4/2007 | Von Merveldt | |
| 2005/0092638 | A1 * | 5/2005 | Michaels et al. | 206/386 |

* cited by examiner

*Primary Examiner*—Bryon P Gehman
(74) *Attorney, Agent, or Firm*—Garvey, Smith, Nehrbass & North, L.L.C.; Gregory C. Smith

(57) ABSTRACT

A pot belly bag which includes a bag portion having four walls and a top portion, and a floor portion; a portion extending outwardly and downwardly from the floor portion, which defines a pot belly portion; a pair of sleeves formed along either sidewall of the pot belly portion with the sleeves tied to the pot belly portion of the bag which results in the pair of sleeves and the pot belly portion functioning as a united unit to overcome various stresses normally placed upon the bag by a free flowing product in the bag which may attempt to push sidewalls of the pot belly portion outward and contact the plastic channels in an attempt to outwardly displace the channel. As the channel begins to move outwardly it immediately encounters the sleeve which is tied to the pot belly portion which restricts outer movement of the channel and spreads the forces out along its entire length.

8 Claims, 7 Drawing Sheets

POT BELLY BAG WITH A PAIR OF SLEEVES

CROSS-REFERENCE TO RELATED APPLICATIONS

This application claims priority to U.S. Provisional patent application 60/619,853, filed on Oct. 18, 2004, which is incorporated by reference herein.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to fabric bulk bags and more particularly into an improved bulk bag having a floor portion which includes a pair of spaced apart pockets for receiving a rigid member to define a channel through which tines of a forklift may enter. This application incorporates by reference the application entitled "Improved Bulk Bag With Support System" by the same inventor, filed on Dec. 5, 2002 bearing Ser. No. 10/310,476.

2. General Background and Description of the Invention

While incorporating the patent application as referenced above, in his efforts to improve his bulk bag, applicant ran several tests on bags and became enthused by the results. This bag that applicant became aware of was constructed which concentrated on a plastic channel design and how to hold that channel into place. The bag design that applicant witnessed showed good promise in this direction but needed several design changes to eliminate weak points and allow for consistent bag manufacturing. Further, the bag design witnessed by applicant called for puncturing the bag in order to anchor the channel. Applicant believed this caused product leakage and was unacceptable to most in the commercial market. The above-referenced bag design was disclosed in International application entitled "Bulk Bag" by inventors Von Merveldt, et al., filed on Feb. 6, 2004 bearing International Filing No. PCT/IB2004/000297. FIG. 1 in this application illustrates one of the bags made from that design, entitled "Prior Art."

Additionally, applicant is aware of the Liftsystems patent that requires an elastic material to hold the tubes in place as well as several design channels which address the pressure that the channel must withstand. The basic form of the bag design that was witnessed by applicant will not require elastic to hold the channels in place.

However, the tube described in that bag fails to take into account the tremendous pressures that are applied against them whenever the bag is suspended by its loops. The Liftsystems patent, on the other hand, described a much more robust channel.

Patents and published applications will be cited in an Information Disclosure Statement submitted by applicant.

Applicant began concentrating on a bag design that would hold the channels in the correct place and restrict the bottom of the bag from sagging downward. That bag design is the subject of the present invention.

BRIEF SUMMARY OF THE INVENTION

What is provided is a pot belly bag, having a bag portion having four walls, a top portion, a floor portion; a portion extending outwardly and downwardly from the floor portion, which defines the pot belly portion; a pair of channels formed along either sidewall of the pot belly portion with the channel sleeves tied to the pot belly portion of the bag so that a free flowing product which may attempt to push the sidewalls of the pot belly outward contacts the channels in an attempt to outwardly displace the channels, but as the channels begin to move outwardly, the outer sleeves tied to the pot belly which restrict outer movement and spreads the forces out along its entire length to configure a bag which rests securely on a flat surface and can support other filled bags on top.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
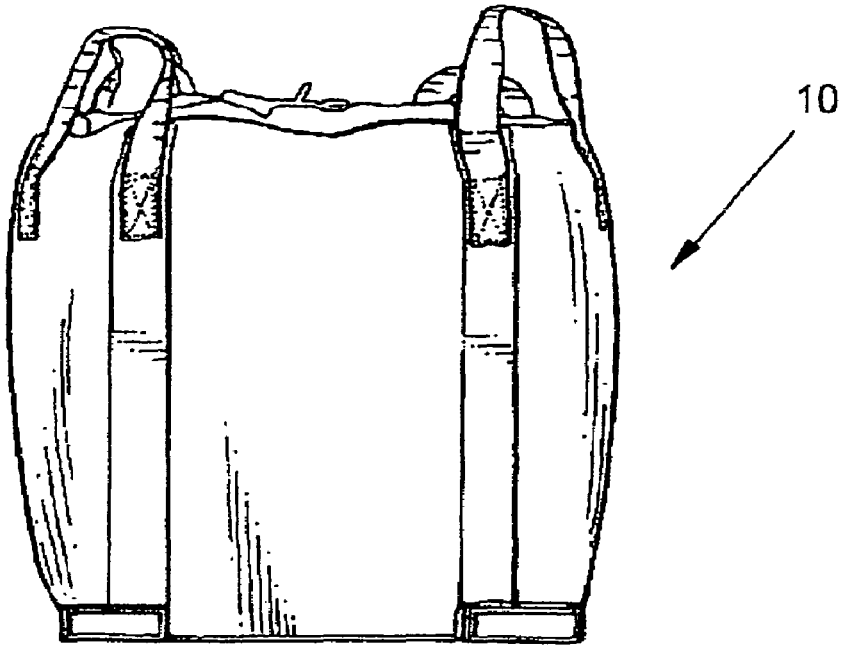
FIG. 1 illustrates an overall view of a prior art bag design.
Figure 2:
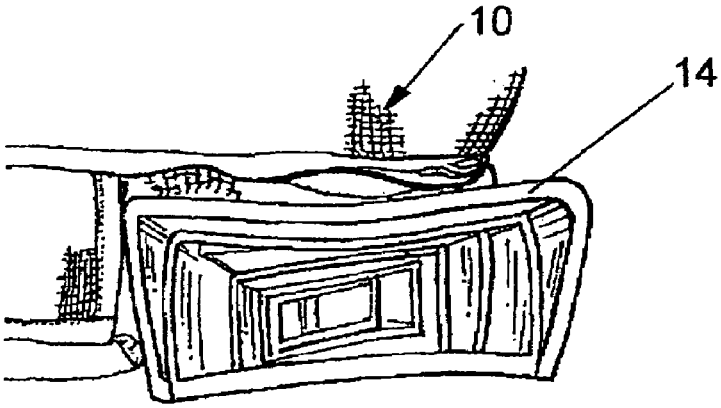
FIG. 2 illustrates an isolated view of a channel of a prior art bag being deformed from force.

As stated earlier, FIG. 1 disclosed a bag 10 known in the prior art which utilizes a pot belly portion 12, with a pair of channels 14 positioned within a sleeve 13, along either side wall 15 of the pot belly portion 12. As illustrated in FIG. 2, there is a close-up of one of the channels 14, of the bag in FIG. 1, showing the bag pressure deforming the channels 14, which makes the bag unstable and difficult to insert a tyne of a forklift into the channel 14.

Figure 3:
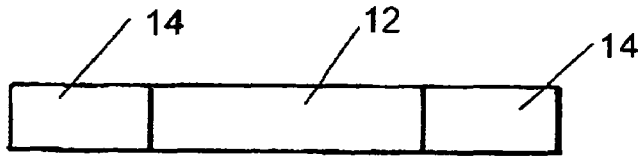
FIG. 3 illustrates a depiction of the pot belly portion of the bag and channels of an empty bag.
Figure 4:
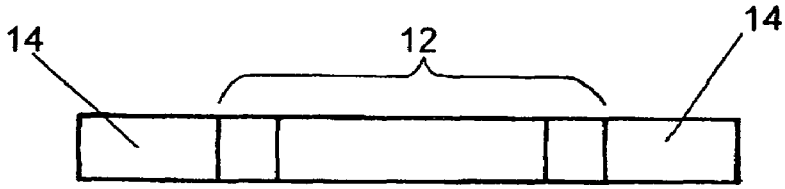
FIG. 4 illustrates a depiction of the pot belly portion and channels of the bag as displaced when filled with material.
Figure 5:
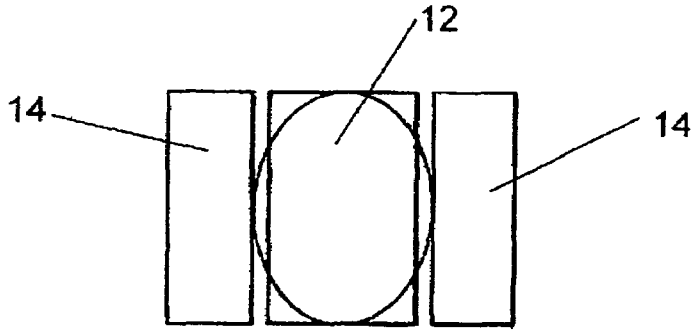
FIG. 5 illustrates a top view of the displacement of the bag when filled.

Applicant has found that free flowing product will always try to form a natural cylinder inside of any constraint. This is the issue that must be overcome in the new and improved bag which applicant calls his pot belly bag. Even though the shape between the channels is rectangular when made, the natural forces of the free flowing product will try to reshape the rectangle into a circle. This pressure disposes the channel outward from the intended position. As seen in FIG. 3, there is depicted a front view of the pot belly bag 10- and the channels 14 while the bag is unfilled. As seen in FIG. 4, after filling, the pot belly portion 12 rounds out and displaces the channel 14 as seen by the arrows. FIG. 5 illustrates a top view of this displacement illustrated in side view in FIG. 4 which shows the original shape of the tray or pot belly 12 (the rectangular portion), and the displacement which has occurred to form the oval 17 illustrated in FIG. 5.

Figure 6:
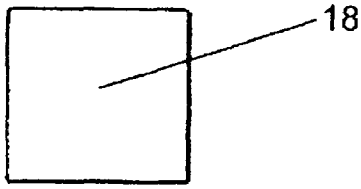
FIG. 6 illustrates a top view of an unfilled bulk bag in a rectangular shape.
Figure 7:
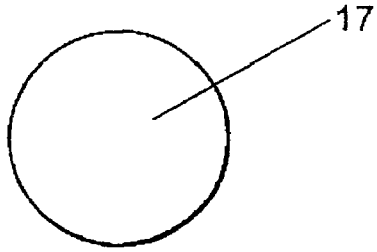
FIG. 7 illustrates a top view of a filled bulk bag in a circular shape.

It should be noted that a standard bulk bag 10 starts out as a 36"×36" bag made in a square configuration 18 as shown in FIG. 6. However, the flexible fabric transforms from a square to a circle 19 that is approximately 45" in diameter as a result of the natural forces of gravity and free flowing product, as illustrated in FIG. 7.

Figure 8:
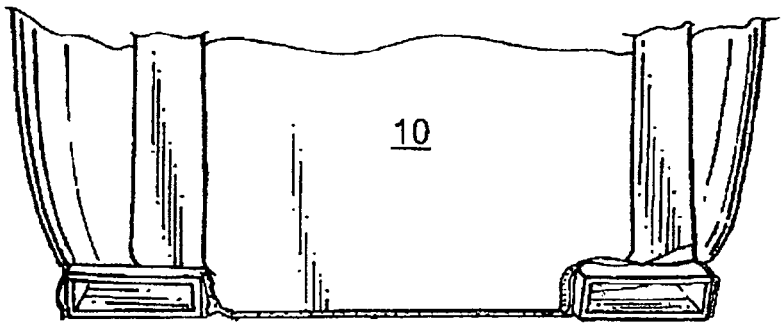
FIG. 8 illustrates a partial isolated view of the channels in a prior art bag.

The bag which was witnessed by applicant, had envisioned putting two sleeves inside the bag and product area forming a space for the channels. This method is difficult to achieve and wasteful of materials. Further, it provides for the bag body fabric to be unbroken between the bag and the pot belly portion. The result of this design is a stress point at the upper inside corners of the channel. In FIG. 8, one can see how close to the corners the stress lines come and this can lead to bag failures at these stress corners.

Figure 9:
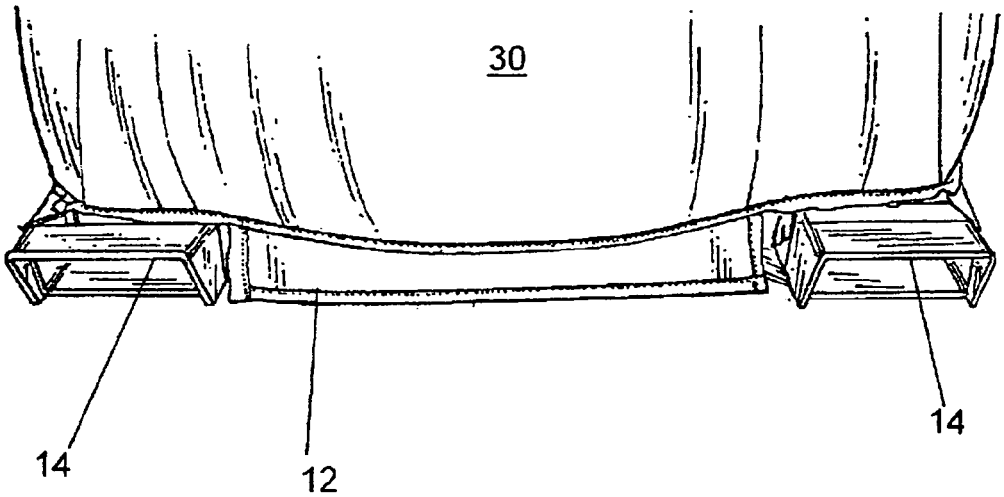
FIG. 9 illustrates a view of the channels of the present invention when the bag is filled.
Figure 10:
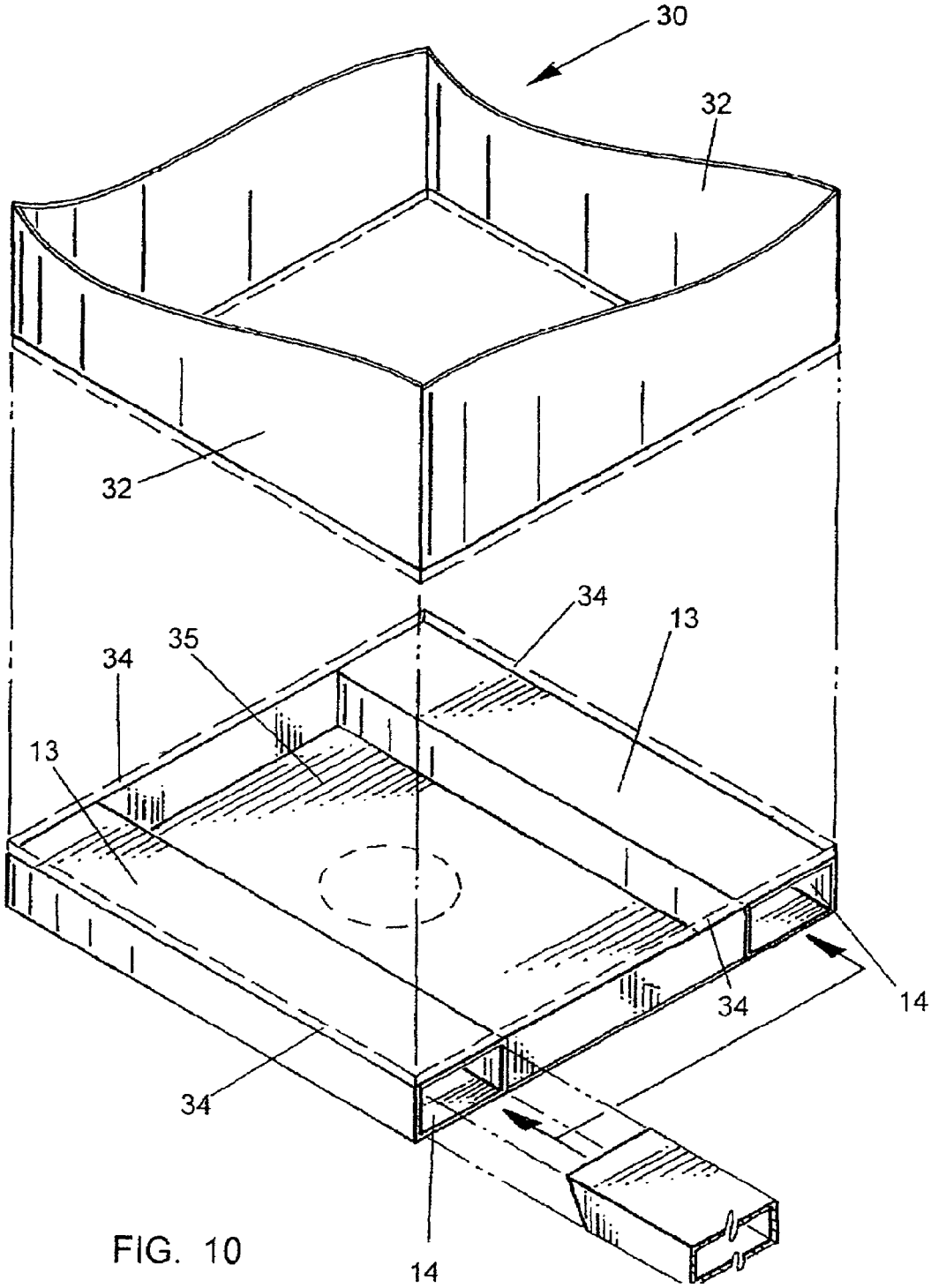
FIG. 10 illustrates an exploded view of the bulk bag portion and the lower end unit of the present invention secured to one another.
Figure 11:
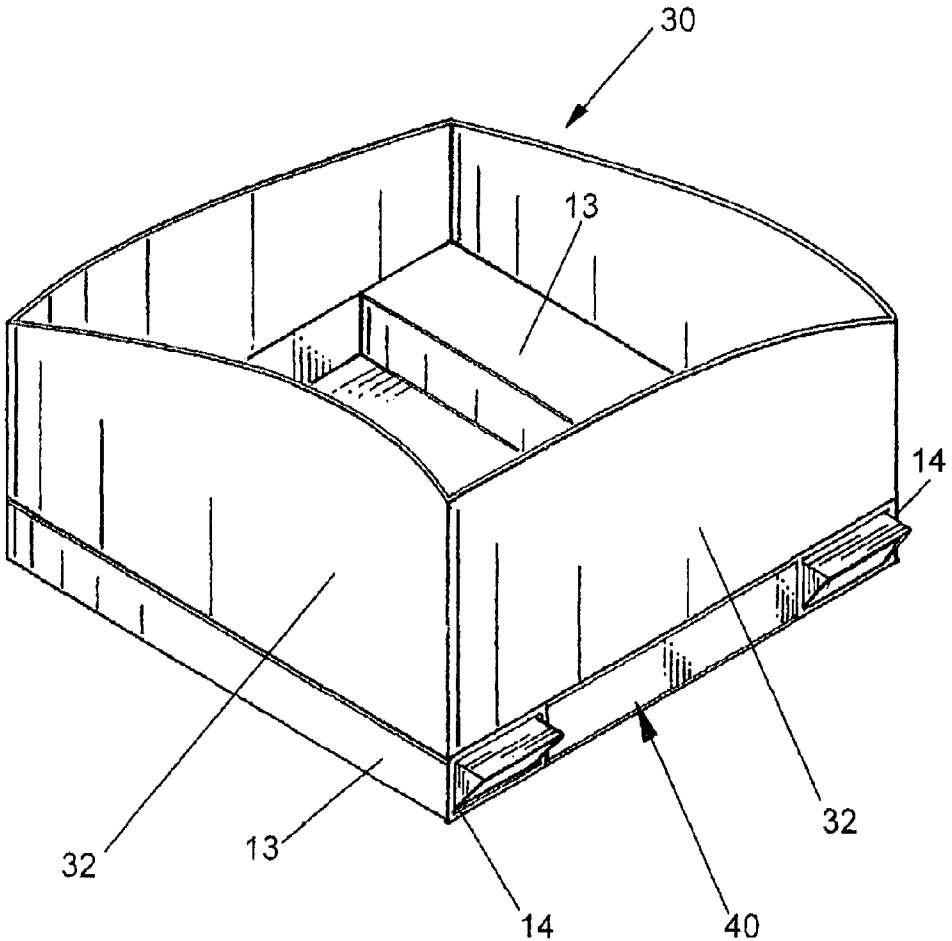
FIG. 11 illustrates an additional view as illustrated in FIG. 10.

Reference is now made to FIGS. 9 through 14, where there is illustrated the improved bag 30 of the present invention. As seen in the figures, applicant is configuring the channel sleeves 13 and the pot belly portion 12, as seen in FIGS. 9 through 11, as a separate unit 40, that is simply added to the bottom of the bag 30 through stitching of the separate unit 40 to the four walls 32 of the bag 30, along perimeter line 34, to complete the bag construction. This does several things. It simplifies production issues, eliminates fabric waste and it provides additional support in the weak areas just previously mentioned.

Applicant intends that this construction as seen in the figures, coupled with a channel 14 that is engineered for the stresses as a complete package, solves the problems encountered in the past. By tying the channel sleeves 13 to the pot belly portion 12 of the bag 30, as seen in FIGS. 9 through 11, the two sleeves 13 and the pot belly 12, with the floor portion 35, are forced to work together as a united unit 40 to overcome the various natural stresses discussed earlier. As the free flowing product attempts to push the side walls 15 of the pot belly outward 12, it contacts the plastic channel 14 and attempts to outwardly displace it. As the channel 14 begins to move outwardly, it immediately encounters the outer sleeve 13 which is tied to the pot belly. The outer sleeve 13 then restricts the movement and in the process spreads these forces out along its entire length.

Figure 15:
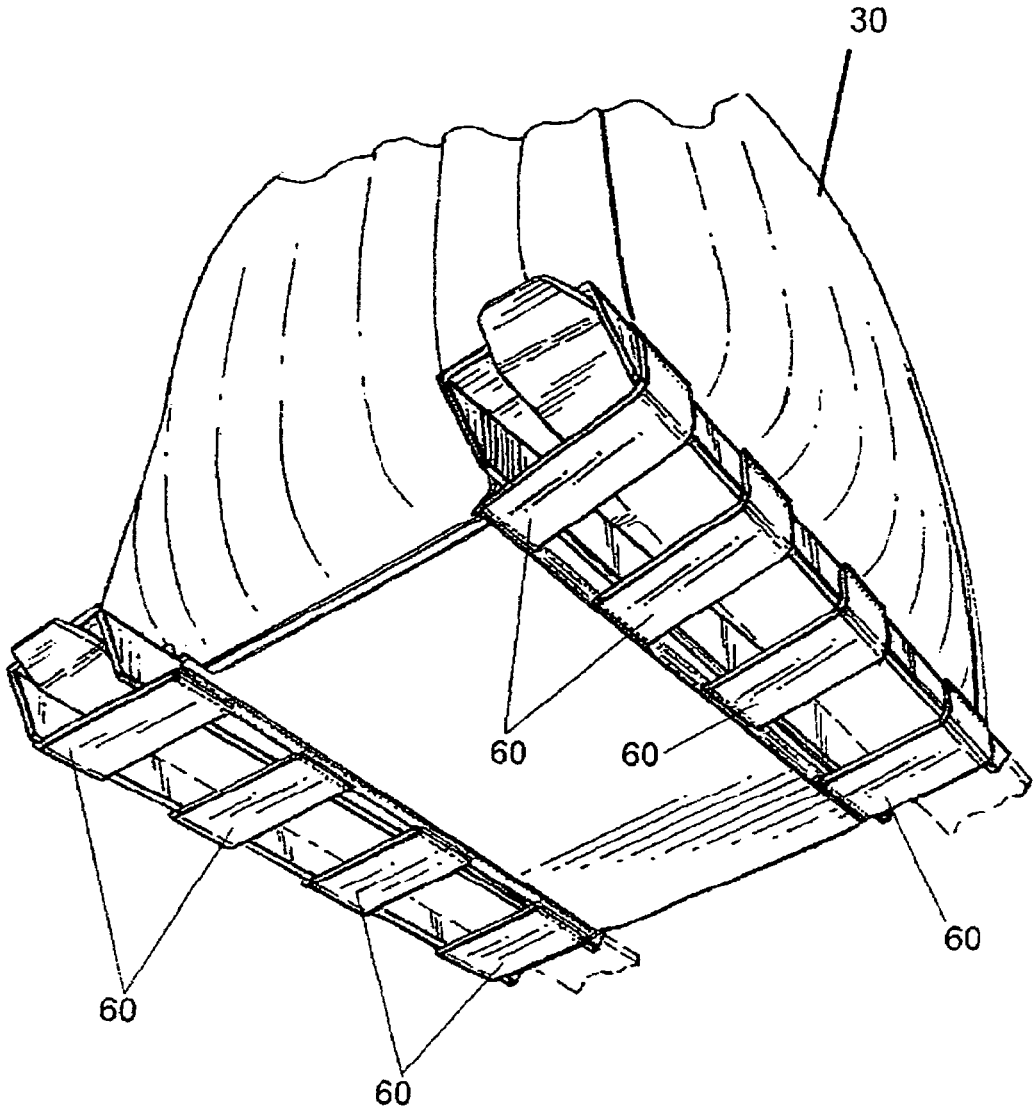
FIG. 15 illustrates an alternate means for holding the channels in position with the pot belly portion.

As a substitute for the sleeves 13, applicant has provided an alternative means for preventing the bag from bulging and deforming the channels 14, as seen in FIG. 15. There would be provided a series of straps 60 extending from the pot belly portion 12, over the channels 14 and secured to the side wall of the bag 30. The straps 60, as seen in FIG. 15, would replace the sleeves 13, and would hold the channels 14 in place. Should the pot belly portion 12 tend to bulge outward, the straps would prevent this from occurring, and the channels 14 would not be deformed. It is foreseen that the channels may include a means for preventing the channels from sliding out of the straps when a forklift tine makes contact, such as protrusions or adhesion material.

Figure 12:
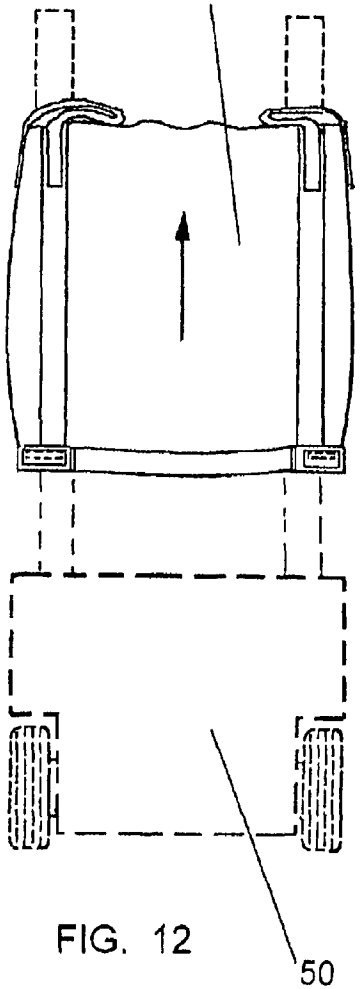
FIGS. 12 and 14 illustrate views of the bulk bag of the present invention lifted by a forklift.
Figure 14:
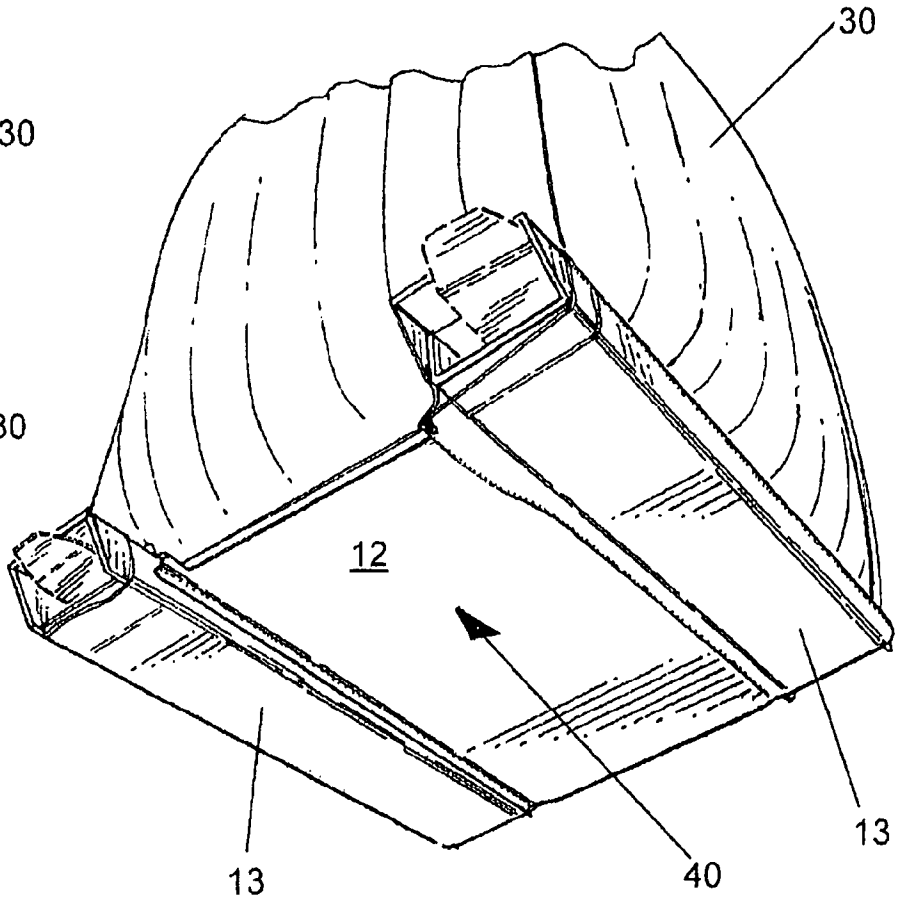

With applicant's new design, elastic will not be needed to maintain the position of the channels. Once the bag is filled, the outward force of the product applies great pressure to the channels and holds them in place for most applications. However, applicant believes that perhaps the addition of small protrusions from the channels will increase the hold between the channels and the sleeves and prevent the channels from being ejected in even very severe applications. As illustrated in FIGS. 12 and 14, the new and improved pot belly bag of the present invention is suspended by a forklift 50.

Figure 13:
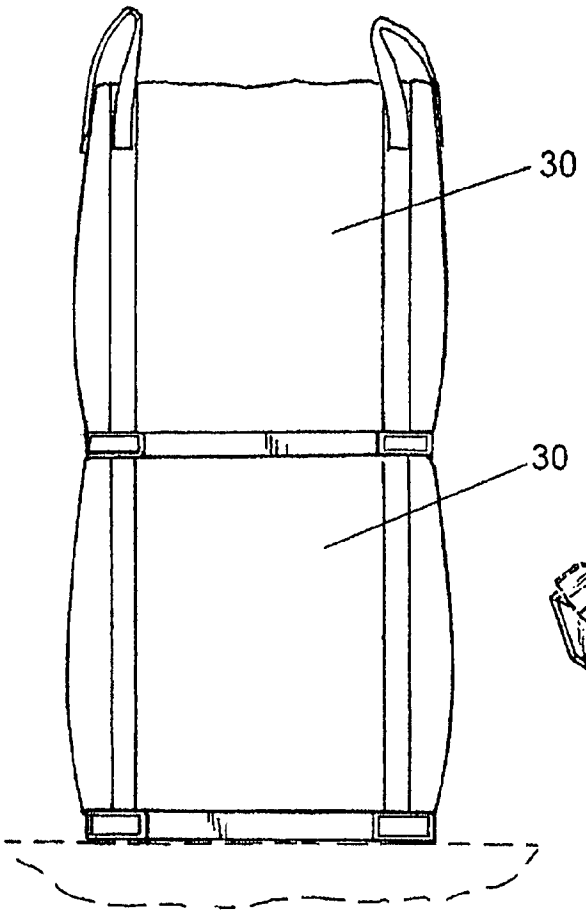
FIG. 13 illustrates a pair of filled bulk bags stacked upon one another of the present invention.

As illustrated in FIG. 13, the pot belly bag 30 of the present invention indicates two of the pot belly bags 30 filled with materials stacked showing the openings which are created by the channels 14 which can be easily accessed by tines of a forklift 50. There should be noted how straight these bags 30 stack upon one another without the use of pallets or the like and how the bag bottom 21 and sides 19 maintain their integrity as was discussed earlier.

All measurements disclosed herein are at standard temperature and pressure, at sea level on Earth, unless indicated otherwise.

PARTS LIST

| Part Number | Description |
|---|---|
| 10 | prior art bag |
| 12 | pot belly portion |
| 13 | sleeve |
| 14 | channels |
| 15 | sidewalls |
| 17 | oval |
| 18 | square |
| 30 | improved bag |
| 40 | unit |
| 32 | walls |
| 34 | perimeter line |
| 35 | floor portion |
| 50 | forklift |
| 60 | straps |

The foregoing embodiments are presented by way of example only; the scope of the present invention is to be limited only by the following claims.

The invention claimed is:

1. An improved pot belly bag which comprises:

a) a bag portion having four sidewalls and a top portion, and a floor portion;

b) a portion extending outwardly and downwardly from the floor portion, having a pair of sidewalls which defines a pot belly portion;

c) a pair of channel sleeves formed along either sidewall of the pot belly portion with the channel sleeves tied directly to the pot belly portion of the bag which results in the channel sleeves and the pot belly portion functioning as a united lower unit permanently engaged to lower ends of the four sidewalls to overcome various stresses normally placed upon the bag.

2. The improved pot belly bag in claim 1, wherein the bag provides a means for preventing free flowing product from pushing the sidewalls of the pot belly portion outward and contacting and deforming plastic channels positioned within each channel sleeve by encountering an outer sleeve which is tied to the pot belly portion to restrict outer movement and spread the forces out along its entire length.

3. The improved pot belly bag in claim 2, wherein the lower unit allows that the plastic channels within the sleeves are maintained undeformed when the bag is filled with material.

4. The improved pot belly bag in claim 1, wherein the lower unit is engaged to the bag portion through stitching along lower ends of the four sidewalls to the lower unit.

5. A pot belly bag, comprising a bag portion having four walls, a top portion, a floor portion; a portion extending outwardly and downwardly from the floor portion, which defines a pot belly portion; a pair of sleeves formed along sidewalls of the pot belly portion with the sleeves tied directly to the pot belly portion of the bag to define a lower unit permanently engaged to the bag portion so that a free flowing product which may attempt to push the sidewalls of the pot belly portion outward contacts channels within the sleeves in an attempt to outwardly displace the channels, but as the channels begin to move outwardly, the sleeves tied directly to the pot belly portion restrict outer movement and spread the forces out along their entire lengths to configure a bag which rests securely on a flat surface and can support other filled bags on top.

6. An improved pot belly bag which comprises:

a) a bag portion having four walls and a top portion;

b) a lower unit permanently engaged to the bag portion, the lower unit comprising a pot belly portion and a pair of sleeves formed along sidewalls of the pot belly portion with the sleeves tied directly to the pot belly portion of the bag resulting in the pair of sleeves and the pot belly portion of the lower unit to overcome various stresses normally placed upon the bag.

7. The bag in claim 6, wherein the lower unit is engaged to the bag portion through stitching along lower ends of the bag walls to the lower unit.

8. The bag in claim 6, wherein the lower unit allows that plastic channels within the sleeves are maintained undeformed when the bag is filled with material.

* * * * *